US012799648B2

(12) United States Patent
Weizenegger et al.

(10) Patent No.: US 12,799,648 B2
(45) Date of Patent: Nov. 17, 2026

(54) NONWOVEN MATERIAL WITH IMPROVED MD/CD RATIO, METHOD FOR ITS MANUFACTURE AND ITS USE

(71) Applicant: JOHNS MANVILLE, Denver, CO (US)

(72) Inventors: Hermann Weizenegger, Schwabmunchen (DE); Christopher William Froiland, Landrum, SC (US); Joerg Lehnert, Schwabmunchen (DE)

(73) Assignee: Johns Manville, Denver, CO (US)

( * ) Notice: Subject to any disclaimer, the term of this patent is extended or adjusted under 35 U.S.C. 154(b) by 492 days.

(21) Appl. No.: 18/207,878

(22) Filed: Jun. 9, 2023

(65) Prior Publication Data

US 2024/0011207 A1 Jan. 11, 2024

(30) Foreign Application Priority Data

Jul. 5, 2022 (EP) ..... 22183129

(51) Int. Cl.
*D04H 3/011* (2012.01)
*D04H 3/004* (2012.01)
(Continued)

(52) U.S. Cl.
CPC ..... *D04H 3/011* (2013.01); *D04H 3/004* (2013.01); *D04H 3/03* (2013.01); *D04H 3/105* (2013.01); *D04H 3/12* (2013.01); *D04H 3/16* (2013.01); *D06N 5/003* (2013.01); *D06N 2201/02* (2013.01); *D06N 2201/082* (2013.01); *D06N 2209/06* (2013.01); *D06N 2209/10* (2013.01); *D10B 2401/04* (2013.01); *D10B 2401/063* (2013.01); *D10B 2505/02* (2013.01); *D10B 2505/18* (2013.01)

(58) Field of Classification Search
None
See application file for complete search history.

(56) References Cited

U.S. PATENT DOCUMENTS

2009/0233073 A1* 9/2009 Bornemann ..... D04H 13/00 442/361
2011/0223402 A1* 9/2011 Gamert ..... C08L 13/00 428/221

(Continued)

FOREIGN PATENT DOCUMENTS

EP 2154281 A2 * 2/2010 ..... D04H 13/00

*Primary Examiner* — Arti Singh-Pandey
(74) *Attorney, Agent, or Firm* — Robert D. Touslee

(57) ABSTRACT

Provided is a nonwoven material as base interlining in sarking, roofing, or coated sealing membrane with an improved isotropy of the material. The nonwoven material comprises a spunbond nonwoven of polyester filaments. The nonwoven has a tensile strength ratio of the specific tensile strength MD to the specific tensile strength CD between 1 and 1.5. The nonwoven material for bituminous roofing membranes has a preferential thermal dimensional stability (TDS), as well as a preferential thermal shrinkage behaviour. Further, a method is provided to manufacture a nonwoven material with an improved mechanical homogeneity. In addition, a bituminous roofing product comprising a nonwoven material according to the invention is provided. The bituminous roofing product is preferably a bituminous roofing membrane.

18 Claims, 4 Drawing Sheets

Figure 1A:
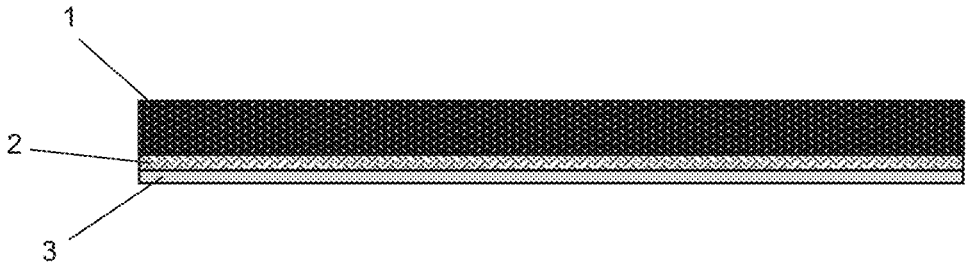

(51) Int. Cl.

| | |
|---|---|
| ***D04H 3/03*** | (2012.01) |
| ***D04H 3/105*** | (2012.01) |
| ***D04H 3/12*** | (2006.01) |
| ***D04H 3/16*** | (2006.01) |
| ***D06N 5/00*** | (2006.01) |

(56) References Cited

U.S. PATENT DOCUMENTS

2017/0121903 A1* 5/2017 Gamert ..... D06N 3/12
2020/0056327 A1* 2/2020 Groh ..... D06M 15/333

* cited by examiner

NONWOVEN MATERIAL WITH IMPROVED MD/CD RATIO, METHOD FOR ITS MANUFACTURE AND ITS USE

The invention relates to a nonwoven material for a roofing product such as a base interlining in sarking, roofing, or coated sealing membranes comprising a spunbond nonwoven of polyester filaments, a method for its manufacture and its use as base interlining in a roofing material.

Membranes and sheets such as a bitumen-containing sheet can be used as roofing construction materials in both residential and commercial applications. These bitumen-containing sheets can contain a nonwoven material as a reinforcement. Nonwoven materials can be produced based on various polymers using spunbond or meltblown production processes. The spunbond process consists of several integrated steps. Spunbond nonwovens are made by spinning continuous polymer filaments onto a moving belt. After the spinning process, the polymer emerges as several thin, continuous filaments. These are cooled and solidified to consistent dimensions before being laid on the belt to form a mat. For consolidation and bonding additional bonding steps are performed. Many bonding methods can be used to bond the filaments in the spunbond process. These include hydroentangle bonding, needle punching bonding, thermal bonding, chemical bonding an others.

Many polymers including polypropylene, polyester, polyethylene, polyamide, polyurethane, etc. are used in the spunbond process. Among various polymers, isotactic polypropylene (PP) is the most widely used polymer for spun bond nonwovens production, because polypropylene is relatively inexpensive. Polyester (PET) has fabric property (tensile strength, modulus, and heat stability) superior to those of polypropylene fabrics is used in almost every nonwoven process technology. However, polyester is more expensive and difficult to process than polypropylene. As a result, more material has to be used, thus the product is more expensive, and the manufacturing process requires more material and energy.

SUMMARY OF THE INVENTION

In accordance with a first aspect of the invention, a nonwoven material as base interlining in sarking, roofing, or coated sealing membrane is provided as defined in claim 1. The nonwoven material comprises a spunbond nonwoven of polyester filaments, the polyester filaments having an individual titer in the range between 1 and 16 dtex. The nonwoven material has a weight per unit area of between 20 and 500 g/m$^2$, a specific tensile strength in machine direction (MD) between 0.3 daN m$^2$/5 cm g to 0.45 daN m$^2$/5 cm g and a specific tensile strength in cross direction (CD) between 0.20 daN m$^2$/5 cm g to 0.35 daN m$^2$/5 cm g. The specific tensile strength is calculated via the formula: (tensile strength in MD+tensile strength in CD)/area weight [daN 5 cm)/(g/m2)].

The nonwoven material is obtainable by a method comprising the steps of

- providing an intermediate bonded nonwoven material by spinning of polyester filaments,
- moving the intermediate nonwoven via belt transportation along a longitudinal path onto or into a stretching device, such as e.g. a stretching table or a tenter frame,
- stretching the nonwoven in a cross direction (CD) perpendicular to the machine direction by 15% to 40% and wherein the tensile strength ratio of the specific tensile strength MD to the specific tensile strength CD, i.e. the MD/CD ratio,

- is between 1 and 1.5 for area weights of between 100 and up to 130 g/m$^2$,
- is between 1 and 1.4 for area weights of between more than 130 and up to 160 g/m$^2$,
- is between 1 and 1.3 for area weights of between more than 160 and up to 200 g/m$^2$,
- is between 1 and 1.25 for area weights of between more than 200 and up to 250 g/m$^2$ and
- is between 1 and 1.2 for area weights of between more than 250 and up to 350 g/m$^2$.

Optionally the area weight of the nonwoven after crossly stretching is between 2-10% lower than the area weight of the nonwoven before crossly stretching and the tensile strength in machine direction (MD) of the nonwoven after crossly stretching is between 1% to 5% lower than the tensile strength MD of the nonwoven before crossly stretching.

In accordance with another aspect of the invention, a method for manufacturing a polyester nonwoven material is provided as defined in claim 10. The method of manufacturing a polyester nonwoven material comprises the steps of:

a. providing an intermediate bonded nonwoven material by spinning of polyester filaments,
b. bonding the polyester filaments, preferably either mechanically by needle punching and/or hydrodynamically, until the bonded polyester filaments become a bonded nonwoven,
c. moving the bonded nonwoven via belt transportation along a longitudinal path onto or into a stretching device such as e.g. a stretching table or a tenter frame,
d. stretching the nonwoven in a cross direction (CD) perpendicular to the machine direction by 5% to 40%,
e. calendering the nonwoven to a thickness between 0.5 mm to 2.0 mm at a temperature between 120° C. and 200° C.,
f. applying a binder and
g. consolidating the nonwoven material at a temperature between 150° C. and 240° C.

In accordance with another aspect of the invention, a bituminous roofing product comprising a nonwoven material according to the invention is provided as defined in claim 13. The bituminous roofing product comprising a nonwoven material according to the invention as a base interlining is preferably a bituminous roofing membrane.

In accordance with another aspect of the invention, the use of a nonwoven material according to the invention as a base interlining for roofing material is provided as defined in claim 17.

The non woven material according to the invention may be manufactured using the method of the invention. All parameters and materials described in the following may be applicable for the nonwoven material according to the invention as well as the method for manufacturing a nonwoven material.

DETAILED DESCRIPTION OF THE INVENTION

Nonwoven Material

As used herein, the term "nonwoven material" refers to a polyester spunbond nonwoven. A polyester spunbond nonwoven is a fabric composed of endless polyester fibres (filaments) oriented in a random pattern and bonded together by thermal, mechanical and/or chemical means resulting in a nonwoven polymeric material that resembles cloth or fabric.

As used herein, the term "polyester nonwoven material" refers to a nonwoven material which comprises a polyester polymer, and which can optionally contain an additional thermoplastic polymer. The polyester polymer can include, for example, a polyester homopolymer, a polyester copolymer or a mixture thereof. For example, the polyester nonwoven material can include a coextruded spunbond fibre including a polyester homopolymer core and a copolymer shell. Any known polyester polymer suitable for fibremaking can be used, preferably a melt-spinnable polyester.

All types of polyester material suited for the production of fibres, as described before, may be used. Preferably, the nonwoven material consists of melt-spinnable polyesters and the polyesters consist of at least 85 mol % polyethylene terephthalate (PET), preferably the polyesters consist of at least 95 mol % of polyethylene terephthalate. Spunbond non-woven materials which consist of at least 85 mol % polyethylene terephthalates are of particular interest for bituminous roofing material reinforcement or interlinings due to their shrinkage behaviour. The remaining 15 mol % may consist of or comprise dicarboxylic acid units and glycol units, or other modification agents for setting the physical and chemical characteristics of the fiber material. Polyesters containing at least 95 mol % of polyethylene terephthalate (PET) are particularly preferred, especially those composed of unmodified PET. The individual titers of the polyester filaments in the spunbond non-woven shall be in the range between 1 and 16 dtex, preferably between 2 and 8 dtex.

For a flame retardancy effect, modified polyesters can be used. Such flame retardantly modified polyesters are known. They contain additives of halogen compounds, particularly bromine compounds or, which is particularly advantageous, they contain phosphonic compounds that are condensed into the polyester chain.

For improving the mechanical properties of the nonwoven material as a base interlining reinforcing filaments can be used. The forces acting on the nonwoven material are favourably directed to the reinforcing filaments such that damage to the nonwoven material may be avoided.

As reinforcing filaments multi- and/or monofilaments are preferred based on aramids, preferably so-called high-module aramids, carbon, glass, glass rovings, mineral fibres (basalt), high-strength polyester monofilaments or multifilaments, high-strength polyamide monofilaments or multifilaments, as well as hybrid multifilament yarns (yams containing reinforcing filaments and lower melting binder fibres) or wires (monofilaments) made of metals or metallic alloys.

A preferred reinforcement material consists of glass multifilaments in the form of—essentially—parallel warps or scrims. In most cases the non-woven materials are reinforced in MD by—essentially—parallel warps. The reinforcing filaments may be used as woven fabric, scrim, knitted fabrics or as non-woven fabric by themselves or in the form of an individual textile fabric. Reinforcements with parallel reinforcing filaments, e.g. warps, as well as scrims or woven fabrics are preferred.

For further reinforcement glass fibers with a titer of between 20 tex and 150 tex, in particular 34 tex, 68 tex and 128 tex can be spun into the non-woven material. Alternatively, or in addition, a glass roving having a titer in between 15 tex to 70 tex can be incorporated into the nonwoven. Favorable mechanical properties of the nonwoven material can be obtained by using reinforcing filaments and/or yarns whose Young module is at least 50 GPa, preferably at least 60 GPa, particularly preferred more than 70 GPa.

A fusible binder can be applied to the non-woven material, such binder comprising for example hot melt adhesive fibers. The hot melt adhesive fibers may be derived from any thermoplastic filament-forming polymers. Such hot melt binder spunbonded non-wovens are described, for example, in EP-A 0,446,822 and EP-A 0,590,629.

Modified polyesters fibers having a melting point 10 to 50° C., preferably 30 to 50° C., lower than the base raw material of the non-woven fabric are particularly considered as hot melt adhesive. Examples of such a hot melt adhesive are polypropylene, polybutylene terephthalate, or polyethylene terephthalate modified by the condensation of longer-chain diols and/or isophthalic acid or aliphatic dicarboxylic acid. The hot melt adhesive is preferably incorporated into the nonwoven material in fibrous form.

The polyester nonwoven material can be formed from a single layer of material or a plurality of layers of material. In a preferred embodiment, the polyester nonwoven material is formed from three or four layers of material. In the case where a plurality of layers of material is used, a binder can be applied to one or more of the layers in order to bind the layers together.

The weight per unit area of the spunbond non-woven material is between 20 and 500 g/m2, preferably 40 and 400 g/m2, particularly between 90 and 250 g/m2.

The nonwoven material may have a thickness between 0.5 mm to 2.0 mm. The nonwoven material may further have a width between 800 mm to 5000 mm.

The Thermal Dimensional Stability (TDS) of the nonwoven material, being needle punched, chemically bonded with a binder is favourably below 1.6% in MD and below 1.7% in cross direction. The TDS requirements depend on the technical application and specific product dimensions, in particular for bituminous roofing sheets, wherein the Thermal Dimensional Stability (TDS) has to be below 1.5%, preferably below 1.0%, %, more preferably below 0.5% and particularly preferred below 0.1% in MD and/or in cross direction. The use of a chemical binder system in combination with the stretching process can improve the Thermal Dimensional Stability (TDS) of the nonwoven material In a preferred embodiment the non-woven is obtainable by a method further comprising the steps of bonding by needle-punching and chemical bonding. Such a bonding further improves the application properties of a roofing reinforcement or base interlining sheet.

The step of providing an intermediate bonded nonwoven material by spinning of polyester filaments may comprise

- spinning continuous polymer filaments, cooling and solidifying the filaments,
- laying down continuous load-bearing polyester filaments having a filament linear density of 1 to 16 dtex, which are spun side by side, to form a random web in a conventional manner,
- bonding the polyester filaments, preferably either mechanically by needle punching and/or chemically with a meltable binder and/or hydrodynamically, until the bonded polyester filaments become a nonwoven.

The nonwoven material may be obtainable by a method further comprising the steps of

- calendering the nonwoven material with binder to a thickness between 0.5 mm to 2.0 mm at a temperature between 120° C. and 200° C.,
- applying a binder and
- consolidating the nonwoven material at a temperature between 150° C. and 240°

Any type of suitable binder may be used for the nonwoven material such as e.g. hot melt adhesives or chemical binders. Preferred suitable binder are chemical binder dispersions described below.

The stretching the intermediate nonwoven material in a cross direction (CD) perpendicular to the machine direction (MD) by 5% to 40% may be conducted in a stretching device such as e.g. a tenter frame or a stretching table. The cross stretching can be performed at a line speed between 10 m/min and up to 70 m/min, depending on the area weight of the needled intermediate nonwoven.

The nonwoven material according to the invention advantageously has a lower MD/CD tensile strength ratio than unstretched nonwoven materials.

The nonwoven material according to the invention advantageously has a higher isotropic tensile strength. In a roofing application a non woven reinforcement mat has to provide a minimum isotropic tensile strength i.e. a minimum tensile strength at any angle or direction. The tensile strength in machine direction/mean manufacturing direction MD is always higher as the fabric is repeatedly stretched in MD direction. The stretching in machine direction MD is a result of the transportation during manufacturing. The intermediate nonwoven fabric is transported via a conveyor mechanism, in particular via at least one conveyor belt and/or via at least one conveyor roll. The conveyor mechanism induces a drag onto/into the nonwoven fabric in machine direction (MD), resulting in a stretching or drawing in MD in the manufacturing process. This MD drag or stretching results in a higher tensile strength in MD. Nonwoven fabrics having lower area weights in the range of 50-150 g/m$^2$ show a higher MD/CD tensile strength coefficient compared to nonwoven fabrics with a higher area weight between 150-250 g/m$^2$ and above. This is due to a higher stretching resistance of thicker, high area weight fabrics and due to the fact that thinner, lower area weight fabrics are manufactured at higher line speeds (higher drag).

The lower CD value determines the spunbond type selection regarding tensile strength. If a tensile strength of 300 N/5 cm is required for the roofing application, e.g. in a bituminous roofing membrane, for example a nonwoven material available on the market with an area weight of 210 Thermal Dimensional Stability (TDS) would fulfil the requirement in MD, but not in CD. Therefore, a nonwoven material available on the market with a higher area weight of 150 g/m$^2$ has to be selected having a tensile strength of 310 N/5 cm in CD. As the nonwoven material according to the invention has a better MD/CD ratio and a better isotropy of the tensile strength a nonwoven material with a lower area weight already fulfils the requirements of CD tensile strength and it is not necessary to select a material with a higher area weight. With the nonwoven material according to the invention a material saving of 5% to 8%, preferably 10% or more at an overall improved unidirectional tensile strength distribution is possible.

By cross stretching of the nonwoven material the tensile strength ratio MD/CD decreased. This is based on both a tensile strength de-consolidation or de-strengthening in the main direction (MD) and a tensile strength consolidation or strengthening in cross direction (CD). The specific tensile MD strength decreases during the cross stretching, while the specific tensile strength in cross CD direction increases. A higher CD stretching ratio leads to a higher decrease in MD and a higher increase in CD giving a lower MD/CD ratio.

The nonwoven material preserves its mechanical integrity while subjected to cross stretching. The nonwoven material shows neither a local decrease in mechanical strength or a substantial variation of the tensile strength in both the width or along the length of the nonwoven material. Thus, the nonwoven material fulfils the requirements for any application as reinforcement fabric for sarking, roofing and sealing membranes. On the contrary cross stretching improves the area weight homogeneity in both cross (CD) and length/machine (MD) direction.

Therefore, the invention provides a roofing reinforcement nonwoven material for bituminous roofing membranes having a more isotropic tensile strength.

The nonwoven material for bituminous roofing membranes after CD stretching preserves its performance in view of its thermal dimensional stability (TDS), as well as in view of its thermal shrinkage behaviour.

The crossly stretched nonwoven material may be used for applications requiring a reinforcement such as coated sarking, roofing and sealing membranes, preferably the nonwoven is used for manufacturing coated sarking, roofing and sealing membranes. Apart from that, the nonwoven material according to the invention may be used in flooring applications and in the field of filtration.

The nonwoven material provides a high initial and also a high long term mechanical stability and fulfils the requirement for reinforcement applications in roofing products to withstand high mechanical forces and resistance against varying environmental temperature regimes (up to 80 degrees Celsius or higher in the summer sun and down to significant minus degrees in arctic regions).

Method of Manufacturing a Polyester Nonwoven Material

The method of manufacturing a polyester nonwoven material according to the invention preferably comprises the steps of a. providing an intermediate bonded nonwoven material by spinning of polyester filaments,
b. moving the intermediate nonwoven via belt transportation along a longitudinal path onto or into a stretching device,
c. stretching the nonwoven in a cross direction (CD) perpendicular to the machine direction by 5% to 40%,
d. calendering the nonwoven material to a thickness between 0.5 mm to 2.0 mm at a temperature between 120° C. and 200° C. and
e. optionally applying a binder,
f. consolidating the nonwoven material at a temperature between 150° C. and 250° C.

The steps are performed one after another in the order given above from a. to f.

The intermediate bonded nonwoven material is manufactured by spinning continuous polyester, cooling and solidifying the filaments, laying down the continuous load-bearing polyester filaments, preferably having a filament linear density of 1 to 16 dtex, to form a random web on a conveyor belt, bonding the polyester filaments by needle punching and by chemically bonding with a meltable binder until the bonded polyester filaments become a bonded nonwoven material.

The polyester filaments are made by spinning continuous polymer filaments onto a moving belt. After the spinning process, the polymer emerges as several thin, continuous filaments. These are cooled and solidified to consistent dimensions before being laid on the belt to form the random web (mat). For the spinning a polymer is melted by heating and mechanical action when it is conveyed to an extruder. Then, the molten polymer moves through a screen or a nozzle array. In the extruder the polymer is progressively heated while the melt pressure and temperature are controlled. PET fiber extruder manufacturing process can be conducted at temperatures in the range between 230° C. to 320° C., in particular between 275° C. to 310° C. and pressures in the range of between 30 bar to 200 bar, in particular in between 50 bar to 180 bar and more particularly in between 80 bar to 150 bar.

The molten polymer is conveyed from the feeding device to a spinneret or nozzle array. The molten polymer is emitted through the spinneret holes or nozzles. When the emitted filaments pass through, cool air is directed across the filament bundle to cool the molten filaments sufficiently to cause solidification. Due to the high velocity air, acceleration and accompanying attenuation or stretching of the individual filaments takes place. The attenuation leads to a polymer molecular orientation.

For web formation the filaments are deposited on a moving belt. The fibres or filaments can be laid on the belt by applying a vacuum under the belt. To achieve maximum uniformity and cover mechanical oscillation, electrostatic charging, slot attenuators, air foils, full-width draw rolls or centrifugal foaming can be used for separation and lay down.

The polyester filaments are bonded by needle punching and/or by chemically bonding with a meltable binder until the bonded polyester filaments become an intermediate nonwoven material. For consolidation and bonding by needle punching barbed needles are rapidly passed through the plane of moving spun web. In addition, and for further mechanical strengthening a binder can be applied to the spunbond fabric. Suitable binders are styrene-butadiene based, PVA based, polyurethane based, acrylic based, starch based or reduced sugar based binders or combinations thereof.

In the method according to the invention the nonwoven material is needle punched and then moved via belt transportation along a longitudinal path onto or into a stretching device such as a tenter frame, a stretching table or other stretching device. The nonwoven is stretched in cross (CD) direction to the machine direction (MD) by 5% to 40%, preferably by 15% to 40%, without stretching in machine direction. The cross stretching steps may be performed one after the other or may be performed simultaneously, or even only one stretching step may be performed.

The stretching step can be performed at a line speed between 5 m/min and up to 70 m/min, depending on the area weight of the intermediate nonwoven material, preferably 20 m/min to 50 m/min and has to be phased into the manufacturing line speed.

The stretching in a cross direction (CD) may be applied using carriages, arranged to capture and clamp the nonwoven during cross stretching, the carriages fixing the nonwoven laterally. A large number of carriages are fixed to, and drawn by, endless chains to run on rails on both sides of said stretching table or stretching tenter. The rails and carriages are moved either on wheels or on gliding members between the carriages and the rails. The carriages can be moving on v-shaped rail conducts, wherein the v opens and/or widens in transportation direction. The divergence of the two carriages fixed on both sides of the nonwoven material causes cross drawing of the material in a cross direction.

In a preferred embodiment of the method according to the invention the nonwoven material is stretched in a direction perpendicular (CD direction) to the machine direction until

- the tensile strength ratio of the specific tensile strength MD to the specific tensile strength CD, i.e. the MD/CD ratio, is between 0.9 and 2.0 upon nominal cross stretching of 5% to 40%,
- the area weight of the nonwoven after crossly stretching is between 2-15% lower than the area weight of the nonwoven before crossly stretching and
- the tensile strength in machine direction (MD) of the nonwoven after crossly stretching is between 1% to 5% lower than the tensile strength MD of the nonwoven before crossly stretching.

The known manufacturing process for a polyester nonwoven material according to the state of the art results in a higher tensile strength in machine direction (MD) than in cross direction CD. In the conventional process a spunbond as detailed before is applied to a first section of a belt transportation device, the laid pre spunbond mat or nonwoven fabric is then transported to a second device for applying the chemical binder to a second section of a belt transportation device. To guarantee a close fitting and hand over from the first section to the second section the spunbond has to be kept in a tight formation (close fitting and tightening) in the mean (MD) manufacturing direction. Again, for the next process step, the needle puncturing process the spunbond mat has to be held in a close tight fit. Therefore, with each next hand over or transport step and during transportation in the known process the spunbond web is constantly tightened or dragged in the mean manufacturing direction (MD). The longitudinal tightening is also true for the calender process, a quenching process by two even calender rolls. Thus, the process of the state of the art leads to a nonwoven material with an anisototropic tensile strength distribution.

Figure 1B:
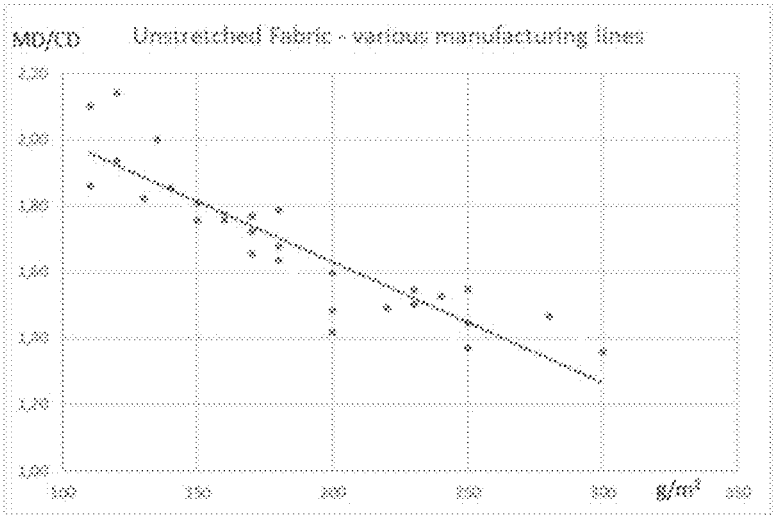

This variation of the MD/CD quotient (tensile strength in MD divided by tensile strength in CD for conventional state of the art not cross stenter fabrics) is shown in FIG. 1*b*. The data points are averaged over numerous manufacturing cycles on different manufacturing lines. The data shows some MD/CD variations for a given area weight. The data is also showing an almost linear trend of decrease of the MD/CD ratio with increasing area weight.

According to the invention after stretching the nonwoven material in a cross direction a binder may be applied to the nonwoven material. Any type of suitable binder may be used for the nonwoven material such as e.g. hot melt adhesives or chemical binders. A chemical binder dispersion may be selected from, polyurethane based, starch based, PVA based, reduced sugar based and styrol-butadien rubber "SBR" dispersion binders and other. Styrol-butadien rubber "SBR" dispersion binders are particularly preferred binders. Combinations thereof can be used in any material and/or volume fraction variation.

The weight of the binder shall be between 5% to 30% of the total weight of the consolidated nonwoven material, in particular its weight shall be of the amount between 15% to 20% of the total weight of the final nonwoven material.

The viscosity of the binder dispersions for application and thorough wetting amounts to between 10 and 800 mPa*s. (determined in accordance with DIN EN ISO 3219 and 23° C.). The viscosity range is chosen to satisfy homogeneous wetting and soaking but should not be too low to avoid gravity flow and low viscosity induced binder dispersion poorness in the upper regions of the fabric.

The binder polymer dispersions are preferably anionic dispersions. Further, bathotonic and/or thermally cross-linkable dispersions may be used. Thermal cross-linkable dispersions that cross-link at a temperature range between 120° C. and 210° C. are preferred.

In an intermediate manufacturing step of the method, the nonwoven material is calendered to a desired thickness and afterwards consolidated (thermal bonding and relaxation/differential thermal shrinkage). Thermal consolidation preferably takes place in a drum dryer. Final consolidation temperatures shall ensure complete polymerization and/or cross-linking of the binder and shall be in the range between 150° C. and 240° C., in particular between 180° C. and 230° C. The nonwoven material can be cut into roles of the desired width.

The thermal consolidation shall at least substantially be achieved in the calender. Therefore, the calender rolls are heated to a temperature of between 120° C. and 180° C. The thermal consolidation shall ensure a mechanical stable nonwoven material, especially when used as a reinforcement fabric, with determined fixed final thickness.

A final thermal consolidation step can take place after thermal calandering.

The method may further comprise spinning glass fibers as reinforcing fibers into the nonwoven before step b., the glass fibers having a titer of between 20 tex and 150 tex, in particular 34 tex, 68 tex and 128 tex and/or incorporating a glass roving having a titer in between 15 tex to 70 tex into the nonwoven before bonding and bonding the reinforcing fibers and/or the glass roving into the nonwoven material.

Favorable mechanical properties of the nonwoven material for use as a base interlining can be obtained by using reinforcing filaments and/or yarns whose Young module is at least 50 GPa, preferably at least 60 GPa, particularly preferred more than 70 GPa.

In an exemplary embodiment a PET base spunbond filament is dispensed on a belt transportation mechanism and reinforcement glass fibers are spun into the nonwoven material. The spunbond is consolidated and bonded by needle punching before cross stretching.

The bonding can be conducted by needle-punching, hydrodynamic bonding or chemical bonding. Needle-punching is preferably conducted with a stitch densities of 20 to 100 stitches/cm2, preferably with 30-80 pricks/cm2. The wording of prick or stitch shall have the same meaning. Hydrodynamic bonding such as waterjet needling is also suitable. Pressure ranges for waterjet needling are preferably between 5 and 600 bar, particularly between 50 and 450 bar, particularly preferred between 100 and 300 bar.

The Thermal Dimensional Stability (TDS) of the nonwoven material obtained by the method being needle punched and chemically bonded with a binder is preferably below 1.6% in MD and below 1.7% in cross direction (CD).

Any of the polymer materials used in a spunbond application and treated as to the inventive tenter process could benefit in view of it's MD/CD ratio—improved tensile strength homogeneity. The nonwoven material has preferably a MD/CD ratio between 1 and 1.3.

Bituminous Roofing Product

Another object of the invention is to provide a bituminous roofing product comprising a polyester nonwoven material according to the invention as a base interlining. The bituminous roofing product can be a bituminous roofing membrane. The bituminous roofing product includes the nonwoven as a base interlining for coated sarking, roofing and sealing membranes.

The bituminous roofing membrane includes the stretched nonwoven material according to the invention. In the following the application of the nonwoven material according to the invention or the nonwoven material manufactured by the method according to the invention as a reinforcement for bituminous roofing membranes is described.

The bituminized roofing material contains at least one layer of nonwoven material, the base membrane, as described above, embedded in a bitumen matrix. The amount of bitumen by weight in relation to the total weight per unit area is preferably between 60 wt % to 97 wt %.

In addition to bitumen, other materials such as polyethylene or polyvinylchloride, polyurethanes, EPDM or TPO (polyolefines) may also be used as coating substances for the coated sarking, roofing and sealing membranes.

The coated sarking, roofing and sealing membranes may be powdered with a granular, in particular fire-resistant material, such as sand and expanded graphite.

The nonwoven material as base interlining or roofing sheet may have a reinforcement as described above. The reinforcement can be achieved by reinforcing filaments or yarns. The selection and volume content of such reinforcing filaments or yarns is chosen such that the reinforcement absorbs a force that may act on the material used as a roofing. Such force may for example be generated by the heating the roofing or cold temperatures in winter times. For bituminous applications reinforcing yarns are used.

In a preferred embodiment of the bituminous roofing product is a bituminized roofing membrane and the nonwoven material is embedded in a bitumen matrix, the bitumen having part by weight of the weight per unit area of the bituminized roofing membrane being preferably 60 to 97 wt % and of the nonwoven material being 3 to 40 wt % and the membrane having a thickness between 3 mm to 5 mm.

The bituminous roofing membrane may further comprise an adhesive layer on the bottom side of the nonwoven reinforcement layer while the bitumen layer is on the top weathering side of the bituminous roofing membrane.

When the polyester nonwoven is used as a carrier in roofing underlayments or commercial built-up roofing systems it gets saturated with bitumen. The high tear strength of the spunbond contributes to the dimensional stability of the bitumen roof. At the same time, the nonwoven provides an excellent elasticity, which makes the roof robust.

The bituminous roofing product including the nonwoven material as a base interlining has an improved isotropic tensile strength compared to conventional products. As the nonwoven material has a higher isotropy the minimum tensile strength at any angle or direction is achieved with a nonwoven material with a lower area weight.

The bituminous roofing membranes preferably have a thermal dimensional stability (TDS) below 1.5%, preferably below 1.0%, more preferably below 0.5% and particularly preferred below 0.1% in MD and/or in cross direction.

The bituminous roofing membranes preferably have a retraction force is below 2.6 N/2.5 m measured by the measure described below.

The heated bitumen during manufacturing of the bitumen membrane can cause an additional shrinkage of the reinforcement sheet based on thermal shrinkage of the binder and fibers. Such shrinkage might result in a buckling of the reinforcement fabric in the bitumen matrix. The buckling can be unfavorable in view of a homogeneous mechanical strength of the bituminous roofing and it might lead to unacceptable defects such as buckled roofing and optical defects on the roofing surface. The reinforcing glass fiber yarns at large shrinkage might have for example to absorb so much tension by the shrinkage that they might show up strongly at the surface of the fabric. Such defects are not acceptable for use in a bituminous membrane due to their visual appearance and the risk of delamination of the yarns from the surface. It was found that a retraction force of >10 N/5 cm and/or a shrinkage of more than 0.5% along the width of the reinforcement fabric can lead to buckling.

For retraction force values above 2.6 N/2.5 cm, the risk of failure of the roofing membrane significantly increases, as the holding bounding force between the bitumen matrix and the fiber spunbond could then be exceeded. As a result, a partial delamination may occur.

The bituminous roofing product according to the invention at a better MD/CD ratio preserves its TDS and is not showing any buckling or optical defects.

An exemplary embodiment of a bituminous roofing membrane according to the invention is shown in a sectional view in FIG. 1*a*. The bituminous roofing membrane has a top layer 1 of bitumen. The top layer is placed onto and integrated into a reinforcement mat 2 of the nonwoven material as described above. On the bottom of the reinforcement mat an adhesive layer 3 is placed.

The samples were tested and measured using the following measuring methods if not further described below:

Area weight: The weight per unit area [area weight] is determined according to DIN EN ISO 29073-1 (1992-08).

Tensile strength: The tensile strength (mechanical strength) is measured according to DIN EN 29 073, part 3 (1992-08).

Specific tensile strength: The tensile strength is measured according to DIN EN 29 073, part 3 (1992-08). The specific tensile strength is calculated via the formula: (tensile strength in MD+tensile strength in cd)/area weight [daN 5 cm)/(g/m2)]. The specific tensile strength is the measured tensile strength of a sample in loading direction (MD,CD) of the load during mechanical stress testing divided by the area weight of such sample.

Thermal dimensional stability (TDS): The thermal dimensional stability (TDS) is determined according to DIN 18192: 1985-08 using a force of 4000 g at 200° C.

The Thermal Dimensional Stability (TDS) is measured as follows: The samples are gained by cutting out material in the dimension of 350 mm×100 mm (1/c). These samples are subjected to a temperature of 200° C. in an oven and stretched by a weight of 4 kg in MD across their overall width for 10 minutes.

The measurement of the dimensional variation is done after a 5-minute cooling while still forced down by 4 kg. The resultant variation is measured.

EXAMPLES

Example 1

As to a first embodiment of the invention a PET base spunbond fibre was dispensed on a belt transportation mechanism, reinforcement glass fibre filaments were spun into the fabric. The spunbond was consolidated and bonded by needle punching. As the area weight amongst other material characteristics determines the tensile strength, the normalized specific strength/specific tensile strength was calculated.

The intermediate nonwoven spunbond product before cross stretching in a tenter had the following material characteristics:

| | | |
|---|---|---|
| PET base fiber titer: | approx. 4 | dtex |
| Area weight: | 160 | $g/m^2$ |
| Tensile Strength - MD: | 56.8 | daN/5 cm |
| Tensile Strength - CD: | 34.5 | daN/5 cm |
| Spec. tensile Strength - MD: | 0.36 | daN $m^2$/5 cm g |
| Spec. tensile Strength - CD: | 0.22 | daN $m^2$/5 cm g |
| Manufacturing line speed | approx. 21 | m/min |
| Tensile strength ratio MD/CD: | 1.65 | |
| Nonwoven mat width: | 1625 | mm |
| Nonwoven mat thickness: | 1.6 | mm |

The intermediate nonwoven material got crossly or perpendicularly stretched to the manufacturing main direction/machine direction (MD) by 15% (nominal machine setting) in cross direction CD.

After 15% nominal cross tenter or stretching the material characteristics were measured. The material characteristics are shown in Table 1:

TABLE 1

Material characteristics of nonwoven material example 1

| | |
|---|---|
| Area weight: | 151 $g/m^2$ |
| Tensile Strength - MD: | 50.0 daN/5 cm |
| Tensile Strength - CD: | 34.2 daN/5 cm |
| Spec. tensile Strength - MD: | 0.33 daN $m^2$/5 cm g |
| Spec. tensile Strength - CD: | 0.23 daN $m^2$/5 cm g |
| Tensile strength ratio MD/CD: | 1.46 |
| Spunbond mat width: | 1810 mm (machine setting 1870 mm) |

The sample data shows that by cross stretching of nominal 15% (machine setting) the tensile strength ratio MD/CD decreased. This based on both a tensile strength de-consolidation or de-strengthening in the main direction (MD) and a tensile strength consolidation or strengthening in the cross direction (CD).

The specific tensile MD strength decreases to 93% of its original value, while the specific tensile strength in cross CD direction increases to 105% of its original value. As the machine setting was set to 1870 mm and the resultant width arrived at 1810 mm some elastic relaxation in stretch direction can be observed.

Example 2

An intermediate nonwoven spunbond product was produced with the parameters described in example 1. The intermediate fabric got crossly or perpendicularly stretched to the manufacturing or main direction (MD) by 20% (nominal machine setting) in CD.

After 20% nominal cross tenter or stretching the material characteristics were measured. The material characteristics are shown in Table 2:

TABLE 2

Material characteristics of nonwoven material example 2

| | |
|---|---|
| Area weight: | 146 g/m2 |
| Tensile Strength - MD: | 46.9 daN/5 cm |
| Tensile Strength - CD: | 34.3 daN/5 cm |
| Spec. tensile Strength - MD: | 0.32 daN m2/5 cm g |
| Spec. tensile Strength - CD: | 0.23 daN m2/5 cm g |
| Tensile strength ratio MD/CD; | 1.37 |
| Spunbond mat width: | 1870 mm (machine setting 1980 mm) |

The specific tensile MD strength decreases to 92% of its original value, while the specific tensile strength in cross CD direction increases to 113% of its original value. By further 5% stretching the tensile strengthening in CD direction increased comparably more then by the first 15% stretch regime. The relaxation was comparably higher.

The results indicate that cross stretching by a tenter will decrease the MD/CD tensile strength ratio. Taking the nonwoven material of example 2 to be selected for a roofing reinforcement application with about 35 daN/5 cm tensile strength value in any direction would usually require a 160 g spunbond. Using the nonwoven material according to the invention such tensile strength value is achievable by a 146 g material, thus saving about 7% of material.

Test of Material Homogeneity

To test the impact of cross stretching on material homogeneity 29 samples were cut out of the intermediate nonwoven material before stretching along its width (CD direction), including the border areas/edge of the material. The intermediate nonwoven material was then crossly stretched at a given line speed. Further 29 samples were cut out of the nonwoven material after cross material stretching. The area weight of all samples before and after stretching was determined.

The intermediate nonwoven material was stretched at a line speed of 30 m/min.

Figure 2:
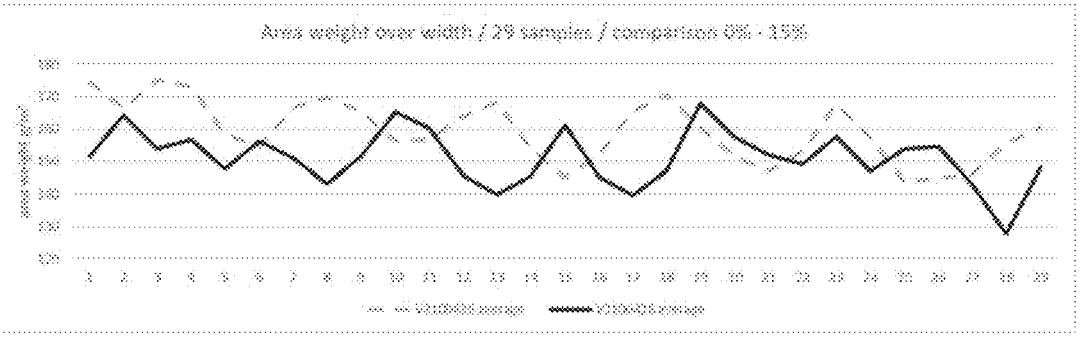

FIG. 2 shows the tested area weight distribution before stretching and after 15% of nominal cross material stretching of the nonwoven material of example 1.

TABLE 3

Average fabric area weight before and after 15% stretching

| | Stretch ratio | Line speed m/min | Average area weight g/m$^2$ | STAB |
|---|---|---|---|---|
| Example 1 | 0% | 30 | 159.5 | 9.4 |
| | 15% | 30 | 151.2 | 8.6 |

Table 3 details the average weight of the samples taken over the width of the fabric. As can be seen the average area weight in CD or width direction was tested to be 159.5 g/m$^2$+/−9.4 g/m$^2$ before and to be 151.2 g/m$^2$+/−8.6 g/m$^2$ after 15% nominal stretching.

This relates to a standard variation in area weight over the whole fabric width of 5.9% before, respectively 5.7% after 15% cross nominal stretching. This data shows that no varying local material cross thickness weakening, rupture or delamination occurred at 15% nominal stretching rate.

Figure 3:
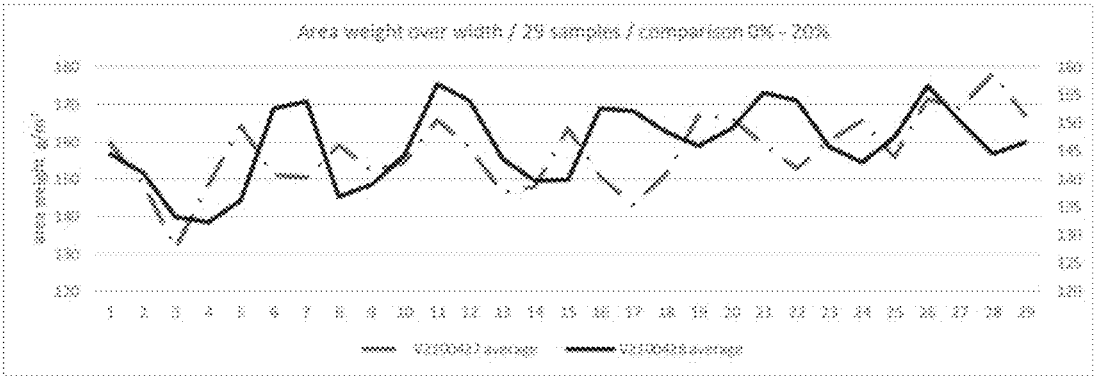

FIG. 3 shows the tested area weight distribution before stretching (sample V2100427) and after 20% of nominal cross fabric stretching. Sample V2100427 is conform to example 1.

An intermediate nonwoven material was stretched at a line speed of 30 m/min.

Table 4 shows test results for the average weight of the samples again taken over the width of the fabric. As can be seen the average area weight in CD or width direction was tested to be 157.3 g/m$^2$+/−9.9 g/m$^2$ before and to be 146.2 g/m$^2$+/−7.0 g/m$^2$ after 20% nominal stretching.

TABLE 4

Average fabric area weight before and after 20% nominal stretching

| Stretch ratio | Line speed m/min | Average area weight g/m$^2$ | STAB |
|---|---|---|---|
| 0% | 30 | 157.3 | 9.9 |
| 20% | 30 | 146.2 | 7.0 |

This relates to a standard variation in area weight over the whole fabric width of 6.3% before, respectively 4.8% after 20% cross nominal stretching. This data shows that no varying local fabric cross thickness weakening, rupture or delamination occurred also at 20% cross stretching while the variation in area weight decreases over the width by stretching in CD.

To test potential material weakening or rupture in length direction or along the fabric roll material 29 samples in width direction were taken at a first length row and at equal distances for four (4) subsequent sample sets (29 each). The area weight and the MD tensile strength of each sample was measured.

Figure 4:
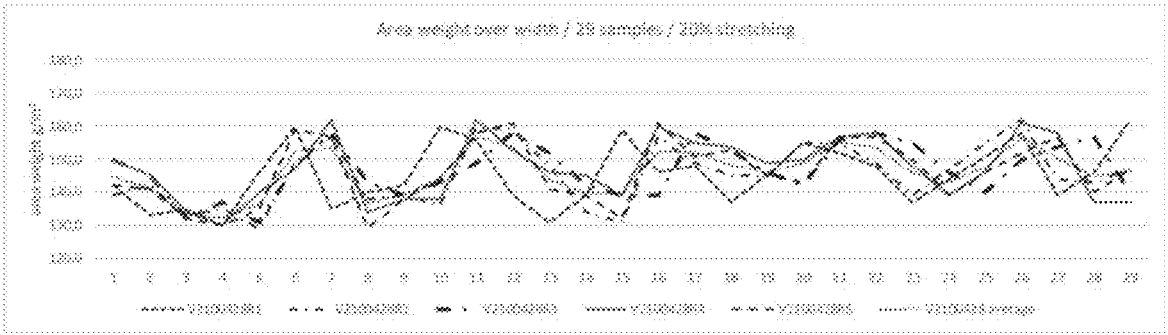

FIG. 4 shows the tested area weight distribution in MD (MD) of the fabric (sample V2100427—sample V2100427 is conform to example 1) at 5 equally distant rows of nonwoven material after 20% nominal cross stretching in length direction of the material roll. The samples were tested and measured with the results summarized in Table 5 below.

TABLE 5

Average material area weight after 20% nominal stretching in MD; single measurement per row

| | Stretch ratio | Line speed m/min | Average area weight g/m$^2$ | STAB |
|---|---|---|---|---|
| Roll 1 | 20% | 30 | 145.3 | 9.4 |
| Roll 2 | 20% | 30 | 145.6 | 9.3 |
| Roll 3 | 20% | 30 | 146.9 | 8.1 |
| Roll 4 | 20% | 30 | 147.3 | 9.5 |
| Roll 5 | 20% | 30 | 146.1 | 9.8 |
| average | 20% | 30 | 146.2 | 7.0 |

The corresponding test data in Table 5 represents an array of 5 rows with 29 samples each, 145 samples in total. As can be seen in table 5 average material area weight in MD or MD was tested to be between 145.3 g/m2+/−9.4 g/m2 before and to be 147.3 g/m2+/−9.8 g/m2 after 20% nominal stretching.

This relates to a standard variation in area weight over the measured fabric length of 7.0% after 20% cross nominal stretching (highest and lowest values taken into calculation).

This data shows no locally varying longitudinal thickness weakening, rupture or delamination in the fabric occurred at 20% cross stretching (MD).

The area weight distribution test data in both width and length direction of the crossly stretched spunbond fabric does not indicate any material weakening. Favourably cross stretching improved the area weight homogeneity in both cross (CD) and length/manufacturing (MD) direction.

Nevertheless, a variation of the tensile strength in manufacturing direction might be induced. To test the tensile strength homogeneity, the samples according to FIG. 4 were tested against their MD tensile strength parameters.

Figure 5:
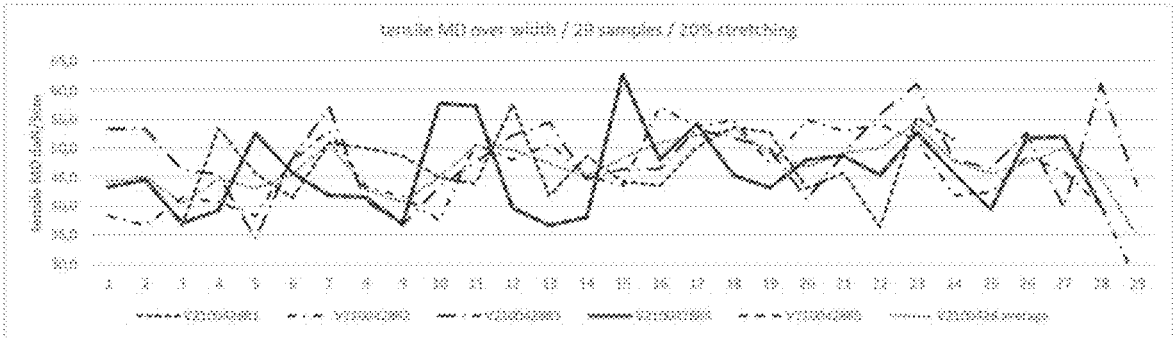

FIG. 5 shows the tested MD tensile strength distribution in MD (MD) of the fabric at 5 equally distant rows of nonwoven material after 20% nominal cross stretching measured in an array in length direction of the material roll.

The tensile strength test data in both width (CD)—as tested shown by FIG. 5 and length direction (MD) of the crossly stretched spunbond fabric does not indicate any material weakening.

TABLE 6

Average MD tensile strength after 20% nominal cross stretching measured at longitudinal distant spaced rows

| | Stretch ratio | Line speed m/min | Average tensile strength MD daN/5 cm | STAB |
|---|---|---|---|---|
| Roll 1 | 20% | 30 | 47.0 | 5.6 |
| Roll 2 | 20% | 30 | 15.9 | 7.1 |
| Roll 3 | 20% | 30 | 48.5 | 6.6 |
| Roll 4 | 20% | 30 | 48.0 | 7.4 |
| Roll 5 | 20% | 30 | 46.1 | 7.0 |
| average | 20% | 30 | 46.9 | 4.2 |

Table 6 corresponding to FIG. 5 details tensile strength MD values of an array of 5 rows with 29 samples each, 145 samples in total. The variation of the average MD tensile strength per row was tested to be between 45.9 daN/5 cm+/−7.1 daN/5 cm and 48.5 daN/5 cm+/−6.6 daN/5 cm after 20% nominal stretching. This relates to a standard variation in MD tensile strength over the measured fabric length of 4.2% after 20% cross nominal stretching (highest and lowest values taken into calculation).

This data shows that also in regard of the tensile strength profile of the fabric mat no locally varying weakening, rupture or delamination in the fabric occurred at 20% cross stretching (CD stretching−MD measurement).

Example 3

Example 3 reflects the applicability and improvement gained by the invention for significant thicker nonwoven materials, having a higher area weight.

A PET base spunbond fiber intermediate product (raw material sample) was manufactured. The intermediate nonwoven was consolidated and bonded by needle punching. The normalized specific strength was calculated out of the test data of the measured area weight and tensile strength (MD,CD).

The intermediate nonwoven material before cross stretching in a tenter had the following material characteristics:

| | | |
|---|---|---|
| PET base fiber titer: | 4 | dtex |
| Area weight: | 299 | g/m2 |
| Tensile Strength - MD: | 101.0 | daN/5 cm |
| Tensile Strength - CD: | 75.9 | daN/5 cm |
| Spec. tensile Strength - MD: | 0.34 | daN m2/5 cm g |
| Spec. tensile Strength - CD: | 0.25 | daN m2/5 cm g |
| Manufacturing line speed | 12 | m/min |
| Tensile strength ratio MD/CD: | 1.33 | |
| Spunbond mat width: | 1030 | mm |
| Spunbond mat thickness: | 1.9 | mm |
| Needle punching: | 50 | Pricks/cm2 |

The intermediate nonwoven material got crossly or perpendicularly stretched to the manufacturing or main direction (MD) in CD between 15%-30%. The nonwoven material had a width before stretching of 1030 mm. Intermediate nonwovens were manufactured on different manufacturing lines and stretched in 3 different power frame facilities to proof universal applicability and repeatability of the results.

Line speeds in the tenter frame were chosen to be between 10 m/min and 100 m/min.

Table 7 shows the material characteristics of a PET nonwoven material with an area weight of 299 g/m$^2$ unstretched and at several stretch ratios between 15% up to 30% cross nominal stretch.

TABLE 7a

Material characteristics of a PET nonwoven material with an area weight of 299 g/m$^2$ unstretched and up to 30% nominal stretch - area weight and tensile strength

| No. | nominal stretch ratio | Area weight g/m$^2$ | Area weight reduction % | tensile strength MC daN/5 cm | tensile strength MD % | tensile strength CD daN/5 cm | tensile strength CD % |
|---|---|---|---|---|---|---|---|
| A | 0% | 299 | | 101.0 | 0% | 75.9 | 0% |
| B | 15% | 282 | −5.5% | 96.0 | −5.0% | 80.4 | 5.9% |
| C | 20% | 276 | −7.7% | 91.7 | −9.2% | 81.7 | 7.6% |
| D | 25% | 271 | −9.3% | 88.6 | −12.3% | 82.1 | 8.2% |
| E | 30% | 268 | −10.2% | 88.4 | −12.5% | 81.2 | 7.0% |

TABLE 7b

Material characteristics of a PET nonwoven material with an area weight of 299 g/m$^2$ unstretched and up to 30% nominal stretch - specific tensile strength

| No. | nominal stretch ratio | spec. tensile MD | spec. tensile MD % | spec. tensile CD | spec. tensile CD % | tensile | spec. tensile % | ratio MD/CD |
|---|---|---|---|---|---|---|---|---|
| A | 0% | 0.34 | 0% | 0.25 | 0% | 0.59 | 0.0% | 1.33 |
| B | 15% | 0.34 | 0.6% | 0.28 | 12.1% | 0.62 | 5.5% | 1.19 |
| C | 20% | 0.33 | −1.6% | 0.30 | 16.6% | 0.63 | 6.2% | 1.12 |
| D | 25% | 0.33 | −3.3% | 0.30 | 19.3% | 0.63 | 6.4% | 1.08 |
| E | 30% | 0.33 | −2.6% | 0.30 | 19.1% | 0.63 | 6.7% | 1.09 |

TABLE 7c

Material characteristics of a PET nonwoven material with an area weight of 299 g/m$^2$ unstretched and up to 30% nominal stretch - width and stretch ratio

| No. | nominal stretch ratio | Area weight g/m$^2$ | width before stretching mm | width tenter machine setting mm | width after tenter mm | Measured stretch ratio % |
|---|---|---|---|---|---|---|
| A | 0% | 299 | 1030 | | | |
| B | 15% | 282 | 1030 | 1190 | 1140 | 11% |
| C | 20% | 276 | 1030 | 1240 | 1170 | 14% |
| D | 25% | 271 | 1030 | 1290 | 1195 | 16% |
| E | 30% | 268 | 1030 | 1340 | 1220 | 18% |

Table 7 shows the effect of nominal (machine setting) cross stretching of 15%, 20%, 25% and 30%. The data reveals an increasing rebounding, spring back of the material upon higher cross stretch parameters. Taking No. C (20% nominal tenter stretch) as an example the spring back in width is 6% resulting in a 14% stretch (CD), whereas upon 30% stretch (No. E) the rebounding increased to 12%.

A carrier nonwoven material of this type shall be suitable as a reinforcement mat for use in sealings for flat roofs, bridges, foundations and tunnels and in particular for bituminous membranes.

Example 4

A couple of PET base spunbond fiber intermediate products (raw material sample) with a targeted weight of 250 g/m$^2$ were manufactured similar to the nonwoven materials in examples 1 and 2.

The intermediate nonwoven materials before cross stretching in a tenter had the following material characteristics as shown in table 8.

TABLE 8

Material characteristics of the intermediate nonwoven materials

| | Unit | 4a | 4b | 4c | 4d |
|---|---|---|---|---|---|
| PET base fiber titer: | dtex | 4 | 4 | 4 | 4 |
| Area weight (intermediates): | g/m2 | 287 | 290 | 283 | 290 |
| Manufacturing line speed | m/min | 30 | 30 | 30 | 30 |
| Spunbond mat width: | mm | 1030 | 1030 | 1030 | 1030 |
| Spunbond mat thickness: | mm | 1.9 | 1.9 | 1.9 | 1.9 |
| Tensile Strength - MD: | daN/5 cm | 119.1 | 110.9 | 115.3 | 111.0 |
| Tensile Strength - CD: | daN/5 cm | 77.5 | 69.6 | 81.2 | 74.7 |
| Tensile strength ratio MD/CD: | | 1.54 | 1.59 | 1.42 | 1.49 |
| Needle punching: | Pricks/cm$^2$ | 50 | 50 | 50 | 50 |
| Binder | | SBR | SBR | SBR | — |
| Thermal consolidation (oven) | ° C. | 200 | 200 | 200 | 200 |

The intermediate fabric got crossly or perpendicularly stretched to the manufacturing or main direction (MD) in CD at a length ratio between 5%-30%.

Figure 6A:
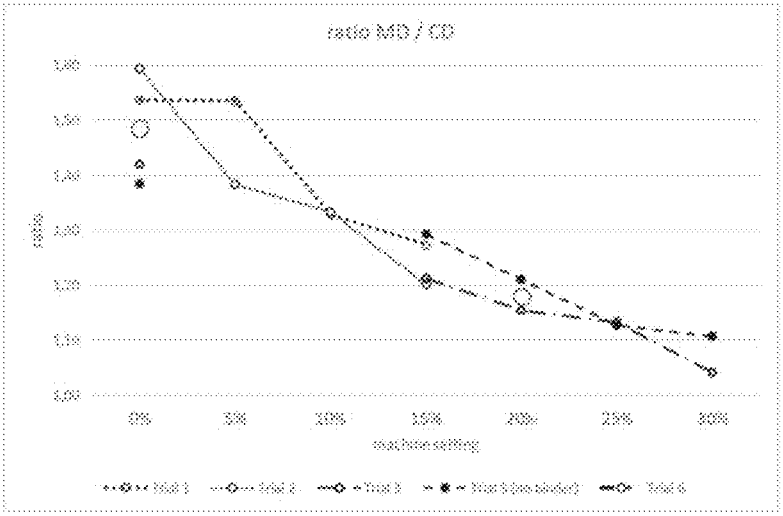
Figure 6B:
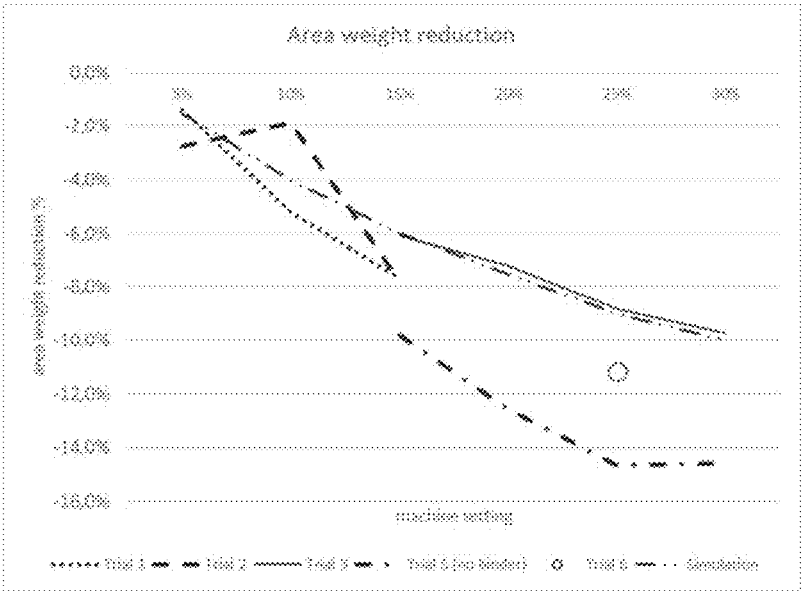

The results for area weight reduction and ratio MD/CD at increasing cross stretching are shown in FIGS. 6*a* and 6*b*. It must be noted that the nonwoven material in trial 5 was manufactured without binder.

The MD/CD ratio in different trials and using distinct materials as listed above, decreases almost linearly and reaches the values shown in table 9. Table 9 also shows the area weight reductions of these samples.

TABLE 9

MD/CD ratio and area weight reductions of nonwoven material with a targeted area weight of 250 g/m$^2$ (shown in FIG. 6a and 6b)

| Trials 1 to 6 | Nominal stretch ratio | Ratio MD/CD | Area weight reduction % |
|---|---|---|---|
| | 10% | >1.4 | 3 |
| | 15% | >1.3 | 6 |
| | 20% | >1.25 | 8 |
| | 25% | >1.2 | 9 |
| | 30% | >1.15 | 10 |

MD/CD Ratios of 20% Cross Stretched Fabrics

Figure 7:
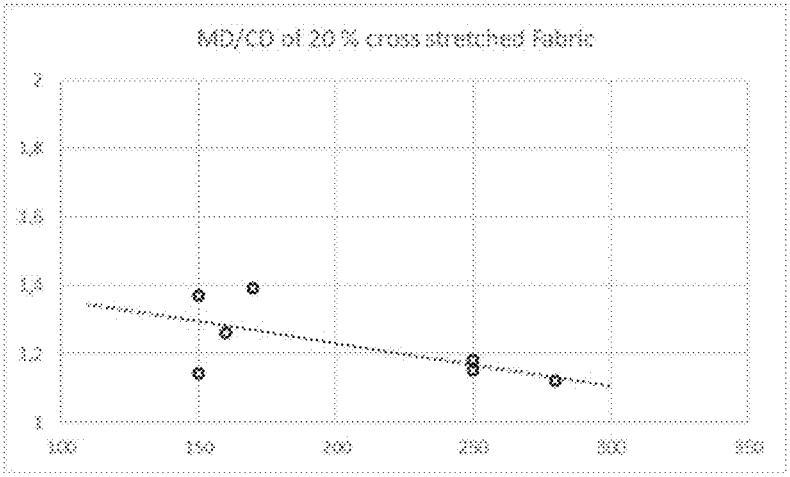

FIG. 7 shows test results of the MD/CD ratios of fabrics of various area weights at after a 20% nominal cross stretching or cross stenter.

In comparison to the unstretched fabrics as to FIG. 1*b* the MD/CD ratio is significantly decreased.

COMPARATIVE EXAMPLES

Comparative Example 1

A PET nonwoven material with a low area weight as available on the market has been tested. The nonwoven material is marketed by Johns Manville as type 059/120 spunbond. Table 10 lists the properties of this known nonwoven material.

TABLE 10

Material characteristics of known nonwoven material type 059/120 (Comperative example 1: C1)

| characteristic | value | Test method |
|---|---|---|
| area weight | 120 g/m$^2$ | DIN EN 29073-1 |
| nominal thickness | 0.85 mm | DIN EN ISO 9073-2 |
| nominal tensile strength MD | 375 N/5 cm | DIN EN 29073-3 |
| nominal tensile strength CD | 220 N/5 cm | DIN EN 29073-3 |
| Elongation at max. tensile strength MD | 30% | DIN EN 29073-3 |
| Elongation at max. tensile strength CD | 30% | DIN EN 29073-3 |
| Shrinkage MD | ≤1% | 10 min, 200° C. |
| Shrinkage CD | ≤1% | 10 min, 200° C. |

The nonwoven material of the comparative example C1 has a maximum tensile elongation at maximum tensile strength of 30% (in MD and CD) direction and shrinkage below 1% (at 10 minutes/200 degree Celsius—in MD and CD direction).

As can be seen from these values the nominal relation between the tensile strength in MD direction and CD direction is as follows:

Tensile strength ration:

ratio MD/CD=375 N/5 cm divided by 220 N/5 cm ratio MD/CD=1.7

Comparative Example 2

A PET nonwoven material as available on the market with a higher area weight has been tested. Table 11 shows the material characteristics for a 250 g/m$^2$ Polyester Spunbond Thread Reinforced fabric that is available in the market. The MD/CD ratio is 1.32.

TABLE 11

Material characteristics of known nonwoven material with high area weight (Comperative example 2: C2)

| characteristic | value | Test method |
|---|---|---|
| area weight | 250 g/m$^2$ | DIN EN 29073-1 |
| nominal thickness | 1.60 mm | DIN EN ISO 9073-2 |
| nominal tensile strength MD | 830 N/5 cm | DIN EN 29073-3 |
| nominal tensile strength CD | 630 N/5 cm | DIN EN 29073-3 |
| Elongation at max. tensile strength MD | 31% | DIN EN 29073-3 |
| Elongation at max. tensile strength CD | 32% | DIN EN 29073-3 |
| Shrinkage MD | ≤1% | 10 min, 200° C. |
| Shrinkage CD | ≤1% | 10 min, 200° C. |

In an example roofing application, namely a bituminous roofing reinforcement, the fabric mat shall be required to have a tensile strength of 75 dN/5 cm in any direction. The nonwoven material C2 with an area weight of 250 g/m$^2$ with the material characteristics as shown in table 11 would not meet such required tensile strength profile as the tensile strength CD in cross direction is only at 63 daN/5 cm. To fulfil the 750 N/5 cm tensile strength performance at least a 300 g/m$^2$ fabric as available in the market would be required.

However, a 30% nominal cross stretched nonwoven as shown in example 3E with a tensile strength MD of 884 N/5 cm and CD of 884 N/5 cm does completely fulfil the specification of 750 N/5 cm, while having an area weight of only 268 g/m2. The MD/CD ratio (example 3E) is 1.09.

Such area weight reduction between the unstretched nonwoven material of Example 3A (zero stretch; stretch ratio in CD 0%) and example 3E (30% nominal stretch; stretch ratio in CD 30%) corresponds to a 10% material saving at an overall improved unidirectional tensile strength distribution.

Example 5

A couple of intermediate or raw material nonwovens for a targeted reinforcement applications as detailed in comparative example 2 were manufactured and transversally stretched (tenter) in the same way as described in examples 1 and 2.

After calender to the determined thickness a binder was applied to the intermediate stretched nonwoven material, the nonwoven material was subsequently dried in a drum at an elevated temperature for complete consolidation of the binder. The chemical binder dispersions for the example nonwoven materials were based on styrol/butadien "SBR".

TABLE 12

Process parameter and material characteristics of nonwoven material example 5

| | Example 5a | Example 5b |
|---|---|---|
| PET base fiber titer: | 4 dtex | 4 dtex |
| Area weight (final reinforcement fabric): | 250 g/m$^2$ | 250 g/m$^2$ |
| Stretch ratio: | 15% | 20% |
| Ratio MD/CD | 1.3 | 1.15 |
| Binder | SBR (pure base) | SBR (pure base) |
| Binder weight fraction | 17% | 17% |
| Calender temperatur | 150° C. | 150° C. |
| Spunbond mat width: (machine setting 1980 mm) | 1870 mm | 1870 mm |

Example 6

A bitumen roofing membrane was manufactured using a nonwoven material according to the invention as a reinforcement mat. An amount of bitumen of 93 wt % was added to a nonwoven material according to the invention with an area weight of 250 g/m$^2$ as to example 5b, to manufacture a 5 mm thick bitumen roofing sheet material. The bitumen was applied at a soaking temperature of between 160 up to 200 degrees Celsius. The bitumen membranes have a typical weight between 2 kg/m$^2$ and 6 kg/m$^2$ at a thickness of between 3 mm to 5 mm.

The Thermal Dimensional Stability (TDS) at 80 Celsius/1 day and the retraction force have been measured.

The test procedure for Thermal Dimensional Stability included the following steps:

Five (5) test pieces were punched out over the width of the bitumen membranes each of the 5 test pieces having a size of 250 mm×50 mm. At the longitudinal ends of the test pieces staples were inserted as measuring points at a distance of approx. 200 mm. The distance between the staples was measured to the accuracy of 1/100 mm. The test pieces were stored for 24 hours at 80° C. in a drying oven and subsequently cooled for a minimum of 1 hr. at 20° C. The distance between the staples was again measured to the accuracy of 1/100 mm. Table 13 shows the results of the measurements:

TABLE 13

Results of test for thermal dimensional stability of bituminous roofing membrane of example 6

| Sample No. | Distance (starting value) | Distance (after 24 Std./80° C.) | Difference % |
|---|---|---|---|
| 1 | 202.24 mm | 201.3 mm | −0.60 |
| 2 | 201.36 mm | 200.14 mm | −0.61 |
| 3 | 202.68 mm | 201.24 mm | −0.71 |
| 4 | 201.14 mm | 200.09 mm | −0.52 |
| 5 | 202.78 mm | 201.47 mm | −0.65 |
| average | | | −0.62 |

The test procedure for retraction force measurements included the following steps: Five (5) test pieces were punched out over the width of the bitumen membranes; each of the 5 test pieces having a size of 250 mm×50 mm. The bitumen was removed using a hot air gun. The test pieces was clamped in a test apparatus. The test pieces with the clamping apparatus was put into a measuring oven, the oven was heated and the retraction forces was measured at 200 after 5 min.

It is known that a retraction force of greater than 10 N/5 cm and/or a shrinkage of more than 0.5% along the width of the reinforcement fabric can lead to buckling. For retraction force values above 2.6 N/2.5 cm, the risk of failure of the roofing membrane significantly increases, as the holding bounding force between the bitumen matrix and the fibre spunbond could then be exceeded. As a result a partial delamination may occur.

The samples of the bitumen membrane according to the invention all show a thermal shrinkage of less than 0.5% thus fulfilling the requirements to avoid buckling. The samples also have a retraction force between 0 and 2.5 N/2.5 cm which is desirable to avoid both buckling and delamination. Such defects are not acceptable for use in a bituminous membrane and can be avoided by using the nonwoven material according to the invention as a base interlay.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

The invention claimed is:

1. A nonwoven material for a roofing product comprising a spunbond nonwoven of polyester filaments, the polyester filaments having an individual titer between 1 and 16 dtex, the nonwoven material having a weight per unit area of between 100 and 350 g/m$^2$, a specific tensile strength in machine direction (MD) between 0.3 daN m$^2$/5 cm g to 0.45 daN m$^2$/5 cm g, and a specific tensile strength in cross direction (CD) between 0.20 daN m$^2$/5 cm g to 0.35 daN m$^2$/5 cm g, wherein a tensile strength ratio of the specific tensile strength MD to the specific tensile strength CD, i.e. a MD/CD ratio, after CD stretching from 15% to 40%:

is between 1 and 1.5 for weight per unit area of between 100 and up to 130 g/m$^2$, is between 1 and 1.4 for weight per unit area of between more than 130 and up to 160 g/m$^2$, is between 1 and 1.3 for weight per unit area of between more than 160 and up to 200 g/m$^2$, is between 1 and 1.25 for weight per unit area of between more than 200 and up to 250 g/m$^2$ and is between 1 and 1.2 for weight per unit area of between more than 250 and up to 350 g/m$^2$.

2. The nonwoven material of claim 1, wherein the weight per unit area of the nonwoven material after crossly stretching is between 2-10% lower than the weight per unit area of the nonwoven material before crossly stretching and the specific tensile strength in machine direction (MD) of the nonwoven after crossly stretching is between 1% to 5% lower than the specific tensile strength in machine direction (MD) of the nonwoven material before crossly stretching.

3. The nonwoven material of claim 1, wherein the nonwoven material consists of melt-spinnable polyesters and the melt-spinnable polyesters consist of at least 85 mol % polyethylene terephthalate (PET).

4. The nonwoven material of claim 3, wherein the melt-spinnable polyesters consist of at least 95 mol % of polyethylene terephthalate.

5. The nonwoven material of claim 1, wherein a Thermal Dimensional Stability (TDS) of the nonwoven is below 1.7%.

6. The nonwoven material of claim 1, wherein the MD/CD ratio is between 1 and 1.3.

7. The nonwoven material of claim 1, further comprising glass fibers with a titer of between 20 tex and 150 tex spun into the nonwoven and/or a glass roving having a titer in between 15 tex to 70 tex incorporated into the nonwoven material.

8. The nonwoven material of claim 1, further comprising a duroplastic binder applied to the nonwoven material.

9. The nonwoven material of claim 1, wherein the nonwoven comprises a thickness between 0.5 mm to 2.0 mm.

10. A method of manufacturing a polyester nonwoven material of claim 1 comprising the steps of:

a. providing an intermediate bonded nonwoven material by spinning of polyester filaments, b. moving the bonded nonwoven via belt transportation along a longitudinal path onto or into a stretching device, c. stretching the nonwoven in a cross direction (CD) perpendicular to the machine direction by 5% to 40%, d. calendering the nonwoven to a thickness between 0.5 mm to 2.0 mm at a temperature between 120° C. and 200° C. and e. applying a binder, f. consolidating the nonwoven material at a temperature between 150° C. and 240° C.

11. A method for manufacturing a polyester nonwoven material according to claim 10 characterized in that the nonwoven material is stretched in a direction perpendicular (CD direction) to the machine direction until the tensile strength ratio of the specific tensile strength MD to the specific tensile strength CD, i.e. the MD/CD ratio, is between 0.9 and 2.0 upon nominal cross stretching of 5% to 40%, the area weight of the nonwoven after crossly stretching is between 2-15% lower than the area weight of the nonwoven before crossly stretching and the tensile strength in machine direction (MD) of the nonwoven after crossly stretching is between 1% to 5% lower than the tensile strength MD of the nonwoven before crossly stretching.

12. A method for producing a reinforced polyester nonwoven material according to claim 10 further comprising:

spinning glass fibers as reinforcing fibers into the intermediate nonwoven material before bonding, the glass fibers having a titer of between 20 tex and 150 tex and/or a glass roving having a titer in between 15 tex to 70 tex into the nonwoven before step b. and bonding the reinforcing fibers and/or the glass roving into the nonwoven material.

13. A bituminous roofing reinforcement material comprising a nonwoven material according to claim 1 characterized in that the roofing product is a bituminous roofing membrane.

14. A bituminous roofing reinforcement material of claim 13 characterized in that bituminous roofing membranes have a thermal dimensional stability (TDS) below 1.5 in MD and/or in cross direction.

15. A bituminous roofing reinforcement material of claim 13 characterized in that bituminous roofing membranes have retraction force which is below 2.5 N/5 cm.

16. A bituminous roofing reinforcement material of claim 13 characterized in that the nonwoven roofing reinforcement material is embedded in a bitumen matrix, the bitumen part by weight of the weight per unit area of the bituminized roofing membrane being 60 to 97 wt % and of the nonwoven being 3 to 40 wt % and having a thickness between 3 mm to 5 mm.

17. A reinforcement material for roofing material comprising the nonwoven material of claim 1.

18. A base interlining in sarking, roofing, or coated sealing membrane, comprising the nonwoven material of claim 1.

* * * * *